US008127484B2

(12) United States Patent
Matthews et al.

(10) Patent No.: US 8,127,484 B2
(45) **Date of Patent: *Mar. 6, 2012**

(54) RAIL CLAMP MOUNT

(75) Inventors: John W. Matthews, Newport Beach, CA (US); Timothy F. La France, Newport Beach, CA (US); Michael D. Picciotta, Yorba Linda, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/077,128

(22) Filed: Mar. 31, 2011

(65) Prior Publication Data

US 2011/0173866 A1 Jul. 21, 2011

Related U.S. Application Data

(63) Continuation of application No. 12/727,100, filed on Mar. 18, 2010, now Pat. No. 7,941,960, which is a continuation of application No. 11/646,870, filed on Dec. 27, 2006, now Pat. No. 7,712,242.

(51) Int. Cl.
*F41C 27/00* (2006.01)

(52) U.S. Cl. ..... 42/90

(58) Field of Classification Search ..... 42/90, 124, 42/127; 89/37.03, 37.04, 37.11
See application file for complete search history.

(56) References Cited

U.S. PATENT DOCUMENTS

| | | | |
|---|---|---|---|
| 3,474,389 | A | 10/1969 | Nagano |
| 3,877,166 | A | 4/1975 | Ward |
| 4,681,476 | A | 7/1987 | Mischenko |
| 4,845,871 | A | 7/1989 | Swan |
| 4,890,407 | A | 1/1990 | Nichols |
| 5,276,988 | A | 1/1994 | Swan |
| 5,458,060 | A | 10/1995 | Casl |
| 6,026,580 | A | 2/2000 | LaRue |
| 6,276,088 | B1 | 8/2001 | Matthews et al. |
| 6,378,237 | B1 | 4/2002 | Matthews et al. |
| 6,442,883 | B1 | 9/2002 | Waterman et al. |
| 6,508,027 | B1 | 1/2003 | Kim |
| 6,606,813 | B1 | 8/2003 | Squire et al. |
| 6,622,416 | B2 | 9/2003 | Kim |
| 6,637,144 | B2 | 10/2003 | Nelson et al. |

(Continued)

OTHER PUBLICATIONS

United States Department of Defense, Military Standard: Dimensioning of Accessory Mounting Rail for Small Arms Weapons, MIL-STD-1913, Feb. 3, 1995.

*Primary Examiner* — Bret Hayes

(74) *Attorney, Agent, or Firm* — Haynes and Boone, LLP

(57) ABSTRACT

A rail clamp mount that may be quickly and easily firmly secured to a rail, such as a rail carried by a gun, and that may be quickly and easily released from the rail. A preferred embodiment comprises a mount base including a first rail-engaging surface; a generally U-shaped, somewhat elastic clamping member carried by the mount base and including two second rail-engaging surfaces at the ends of the legs of the U, and a third second rail-engaging surface at the end of the center section of the clamping member between the legs of the U, the second rail-engaging surfaces being opposed to and transversely spaced from the first rail-engaging surface; a cam mechanism mounting the clamping member to the mount base for imparting transverse movement to the clamping member when actuated; and an actuator for the cam mechanism including a throw handle.

30 Claims, 3 Drawing Sheets

U.S. PATENT DOCUMENTS

| | | | | |
|---|---|---|---|---|
| 6,779,288 | B1 | 8/2004 | Kim | |
| 6,931,778 | B1 | 8/2005 | Nelson et al. | |
| 6,994,449 | B2 | 2/2006 | Kim | |
| 7,117,624 | B2 | 10/2006 | Kim | |
| 7,140,143 | B1 | 11/2006 | Ivey | |
| 7,204,052 | B2 | 4/2007 | Swan | |
| 7,543,405 | B1 | 6/2009 | Ivey | |
| 7,712,242 | B2 | 5/2010 | Matthews et al. | |
| 7,905,045 | B1 * | 3/2011 | Swan | 42/127 |
| 7,941,960 | B2 * | 5/2011 | Matthews et al. | 42/90 |
| 2005/0241212 | A1 | 11/2005 | Swan | |
| 2006/0104064 | A1 | 5/2006 | Sharrah et al. | |
| 2006/0123686 | A1 | 6/2006 | Larue | |
| 2007/0234623 | A1 | 10/2007 | Carney | |
| 2008/0134559 | A1 | 6/2008 | Swan | |
| 2008/0178511 | A1 | 7/2008 | Storch et al. | |
| 2009/0000174 | A1 | 1/2009 | Davis et al. | |
| 2009/0064558 | A1 | 3/2009 | Woroner | |
| 2010/0229449 | A1 | 9/2010 | Matthews et al. | |

* cited by examiner

RAIL CLAMP MOUNT

CROSS-REFERENCE TO RELATED APPLICATIONS

This application is a continuation application of U.S. patent application Ser. No. 12/727,100 entitled "RAIL CLAMP MOUNT" filed Mar. 18, 2010 now issued as U.S. Pat. No. 7,941,960, which is a continuation application of U.S. patent application Ser. No. 11/646,870 entitled "RAIL CLAMP MOUNT" filed Dec. 27, 2006 now issued as U.S. Pat. No. 7,712,242, all of which are hereby incorporated by reference in their entirety.

BACKGROUND OF THE INVENTION

This invention relates to apparatus for mounting an accessory device to a rail, and more particularly to a quick attachment/quick release rail clamp mount for a longitudinal rail which may be carried by a gun.

It is often useful to mount an accessory device, such as a light beam generator, to a rail that may be secured to or otherwise carried by a gun. When the rail is carried by a gun, it is of utmost importance that the mounting apparatus, which interfaces the accessory device and the rail, be firmly clamped or otherwise firmly secured to the rail, while at the same time it is desirable that the rail clamp mount be quickly and easily securable to and removable from the rail.

SUMMARY OF THE INVENTION

Against this background, the present invention provides apparatus for mounting an accessory device to a longitudinal rail, such as a rail carried by a gun parallel to the longitudinal axis of the gun's barrel, the mounting apparatus being quickly and easily clampable to and removable from the rail. According to one aspect of the present invention, there is provided a rail clamp mount apparatus for mounting an accessory device to a longitudinal rail, comprising: a mount base adapted for securing the accessory device thereto and including a first rail-engaging surface; a clamping member carried by the mount base and including at least one second rail-engaging surface opposed to and transversely spaced from the first rail-engaging surface; a cam mechanism mounting the clamping member to the mount base for imparting transverse movement to the clamping member when actuated; and an actuator for the cam mechanism.

In the preferred embodiment, the clamping member is generally U-shaped, the U of the clamping member having a base section and two longitudinally spaced-apart legs extending from the base section, the legs respectively including at the ends thereof two of the second rail-engaging surfaces. The clamping member is preferably somewhat elastic, and includes a center section between the legs and extending from the base section of the U, the center section including a third one of the second rail-engaging surfaces. The center section preferably is transversely shorter than the legs whereby the two second rail-engaging surfaces at the respective ends of the legs engage the rail before the third second rail-engaging surface at the end of the center section engages the rail when the first rail-engaging surface engages the rail and the cam mechanism is actuated.

The cam mechanism of the preferred embodiment includes a circular member rotatably engaging a circular bore in the clamping member and eccentrically rotatable with respect to the mount base. The cam mechanism includes a shaft rotatably secured to the mount base and engaging the circular member for eccentrically rotating the circular member. The actuator includes a handle having an end secured to the shaft for rotating the shaft with respect to the mount base. The handle is rotationally disposable in a first position with the second rail-engaging surfaces disengaged from the rail when the mount base is applied to the rail with the first rail-engaging surface engaging the rail, and the handle is rotationally disposable in a second position for engaging the second rail-engaging surfaces against the rail.

The longitudinal rail to which the preferred embodiment of the present invention may be clamped, may be of a type commonly known as a Picatinny rail including a wedge-shaped surface longitudinally extending along one side of the rail and another wedge-shaped surface longitudinally extending along the other side of the rail. The preferred first rail-engaging surface of the present invention is configured for matingly engaging one of the wedge-shaped surfaces of the rail, and each of the second rail-engaging surfaces is configured for matingly engaging the other of the wedge-shaped surfaces of the rail. Each of such first and second rail-engaging surfaces is preferably generally V-shaped in cross-section and may include a longitudinal groove along the nadir of the V.

BRIEF DESCRIPTION OF THE DRAWINGS

The novel features believed to be characteristic of the present invention, together with further advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
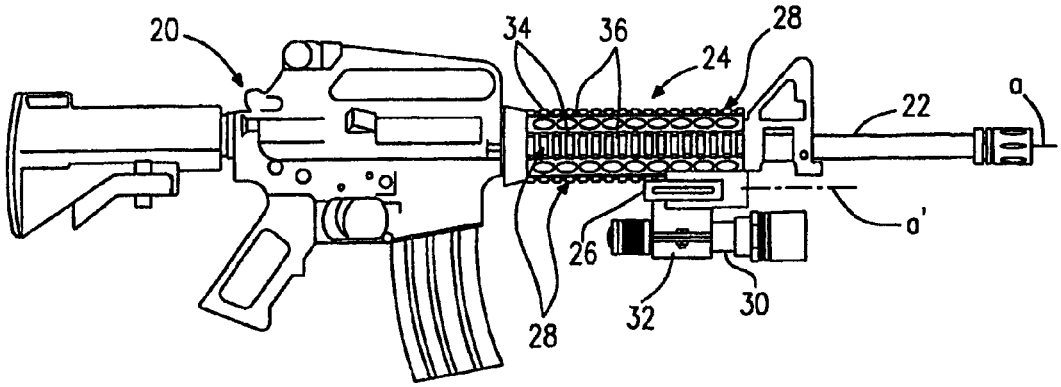
FIG. 1 is a side elevation view of a gun or firearm equipped with a rail structure to which an accessory device is mounted by means of a preferred embodiment of a rail clamp mount apparatus according to the present invention.

Turning to FIG. 1, there is illustrated a firearm or gun 20 having a barrel 22 extending along longitudinal axis a, equipped with a rail structure 24. A preferred embodiment of a rail clamp mount 26 according to the present invention is clampedly mounted to a rail 28 of the rail structure 24, along the rail's longitudinal axis a' which is parallel to the barrel's longitudinal axis a. An accessory device such as a light beam generator 30, for example a flashlight or a laser aiming apparatus, is secured to the rail clamp mount 26, either directly or by an accessory holder or clamp 32 securing the light beam generator 30 to the rail clamp mount 26, such that the generated light beam proceeds along a path parallel to the barrel's longitudinal axis a. As used herein, the word "longitudinal" refers to a direction parallel to the longitudinal axes a and a.

Rail mount structures such as the rail structure 24 are well known in the firearms art, each rail 28 typically comprising a series of longitudinally spaced-apart ribs 34 separated by transverse slots 36 (see also FIGS. 10 and 11), such as a Picatinny rail specified in MIL-STD 1913 incorporated herein by reference. Examples of rail structures 24, including Picatinny rails, are disclosed in U.S. Pat. Nos. 6,508,027, 6,622,416 and 7,117,624, each issued to Paul Y. Kim, and U.S. Pat. No. 6,779,288 issued to Paul Y. Kim and John-W. Matthews, which patents are assigned to the assignee of the present invention and incorporated herein by reference.

Although the rail clamp mount 26 of the present invention is shown as being secured to a rail 28 typically mounted to long arms, the rail clamp mount 26 may also be secured to a rail unassociated with a gun, or to a rail which is integral with: the frame of a firearm such as a handgun, or a rail which may be removably secured to the handgun beneath the handgun's barrel and forwardly of its trigger guard. Such rails for handguns, both integral with the frame and removably attachable to the handgun, as well as lights adapted for being removably attached to such rails, are disclosed in U.S. Pat. Nos. 6,276,088 and 6,378,237, both issued to John W. Matthews and Paul Y. Kim and assigned to the assignee of the present invention, which patents are incorporated herein by reference.

Figure 11:
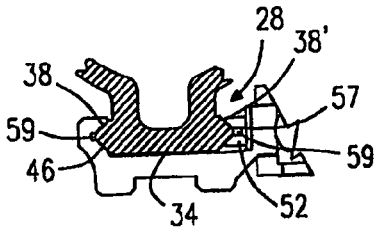
FIG. 11 is a fragmentary cross-sectional view of the rail of FIG. 1 with the preferred clamp mount of the present invention clamped thereto.

Each rail is configured with oppositely outwardly directed wedge-shaped surfaces (in cross-section) longitudinally extending along each side of the rail. In the case of the rail 28 with longitudinally spaced-apart transverse ribs 34, the wedge-shaped surfaces 38 and 38' longitudinally extend along the respective ends of the ribs 34 as illustrated in FIG. 11.

Turning to FIGS. 2-8, the rail clamp mount 26 includes a mount base 40 having a platform 42 from which a longitudinally extending wall 44 projects with a longitudinal first rail-engaging surface 46. The first rail-engaging surface 46 is configured to matingly engage the wedge-shaped surfaces 38 along one side of the rail 28, and preferably comprises a generally V-shaped surface (in cross-section) 46 having its opening longitudinally extending inwardly along one side of the platform 42. The base 40 includes a second longitudinally extending wall projecting from the platform 42, the second wall 46 being transversely spaced from the innermost edge of the first wall 44 by a distance preferably slightly greater than the width (in the transverse direction) of the rail 28 between the rail's outer extremities of its wedge-shaped surfaces 38.

Figure 10:
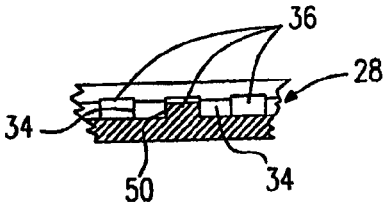
FIG. 10 is a cross-sectional view of a fragment of the mount base shown in secured position to the rail as in FIG. 1.

Also projecting from the platform 42 is a transverse protuberance 50, preferably a rectangular bar 50 having a width (in the longitudinal direction) slightly smaller than the transverse slots 36 in the rail 28, for being received by one of the slots 36 as shown in FIG. 10, when the base 40 is placed to the rail 28 with the rail wedge-shaped surfaces 38 received between the platform's two opposing walls 44 and 48.

The mount base 40 carries a clamping member 52 having at least one second rail-engaging surface opposed to and transversely spaced from the first rail-engaging surface 46 of the mount base first wall 44. In the preferred embodiment, the clamping member 52 is generally U-shaped with two legs 54 generally perpendicularly extending from the base section 56 of the U, and is further configured with a center section 58 extending from the base section 56 of the U and situated preferably midway between the two legs 54. The center section 58 of the clamping member 52 includes a circular bore 60 through the plate's thickness, the center of the bore 60 preferably equally spaced from the legs 54.

The clamping member 52 resides in a passageway 62 of the mount base 40 formed between two flanges 64 extending outwardly from the mount base second wall 48, offset from the platform 42 and preferably substantially parallel to the plane of the platform 42. The passageway 62 has a height dimension (separation between the flanges 64) and a longitudinal dimension slightly larger than the respective thickness and length dimensions of the clamping member 52, for permitting the clamping member 52 to be retainably slidable within the passageway 62 and partially through a longitudinal opening 66 through the mount base second wall 48 (the passageway 62 and the longitudinal opening 66 are shown in phantom in FIG. 4, and are further shown in FIG. 8).

The clamping member 52 is mounted for transverse movement within the mount base 40 by a cam mechanism including a circular member or disk 68 rotatably residing in the clamping member bore 60, and a shaft 70 eccentrically securing the disk 68 to the mount base 40, the shaft extending through bores 72 through the flanges 64 and secured at each end by a throw lever or handle 74. The shaft 70 comprises two half-shafts **70*a*, 70*b* secured together by a headed screw 76 through a bore in one half-shaft 70*a* and a threaded bore 80 in the other half-shaft 70*b*. Each of the half-shafts 70*a*, 70*b* comprises a three-portion construction, each portion preferably being integral with the other two portions. The first portion 82 of each half-shaft 70*a*, 70*b* is configured for being fixedly retained within a mating opening 84 in the ends of the respective arms 86 of the U-shaped handle 74; in the example shown, each first portion 82 and the mating opening 84 are rectangular. Each of the second portions 88 of the half-shafts 70*a*, 70*b* is circular and rotatably fits in the respective flange bores 72. Each of the third portions 90 of the half shafts 70*a*, 70*b* is configured for mating with an off-center opening 92 in the disk 68 for eccentrically rotating the disk 68 in the clamping member 52 when the shaft 70 (comprising the aligned and screw-connected half-shafts 70*a* and 70*b*) is rotated about the shaft axis s which coincides with the centers of the two flange bores 72. In the example of the preferred embodiment, the third portions 90 of the half-shafts 70*a*, 70*b* are rectangular in cross-section and the off-center opening 92 in the disk 68 comprises a slot 92 into which the rectangular third portion 90** is keyed.

During assembly, the half-shafts 70*a*, 70*b* are arranged in their respective throw handle openings 84 (with the handle's arms 86 straddling the mount base 40), flange bores 72 and disk slot 92 such that the slot 92 is longitudinally oriented and inwardly disposed (i.e., between the passageway opening 66 and the center of the disk 68) when the throw handle 74 is in its unactuated position with the clamping member 52 retained substantially within the passageway 62 of the mount base 40. A pair of pins 94 may be fixed to the mount base 40 (e.g., inserted in apertures 96 in flanges 64) for contacting the base 56 of the U-shaped clamping member 52, for restraining the clamping member 52 against rotation about the disk 60 when the throw handle 74 is in its unactuated position.

Figure 12:
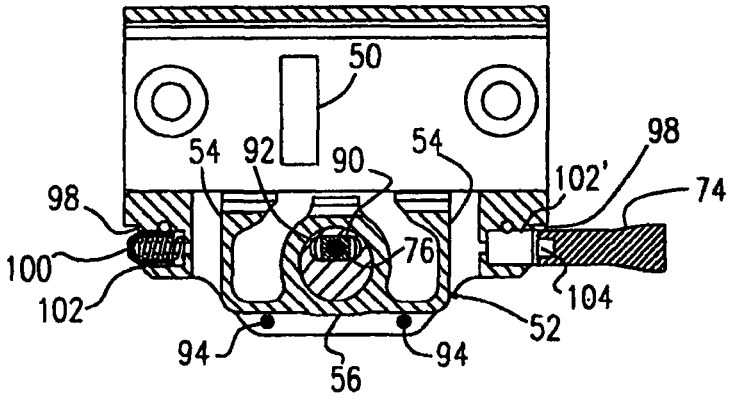
FIG. 12 shows a section of the assembled preferred embodiment of the clamp mount according to the present invention, taken along the line 12-12 of FIG. 8 and viewed generally in the direction of the appended arrows, the clamp mount being shown in its un-actuated position.
Figure 13:
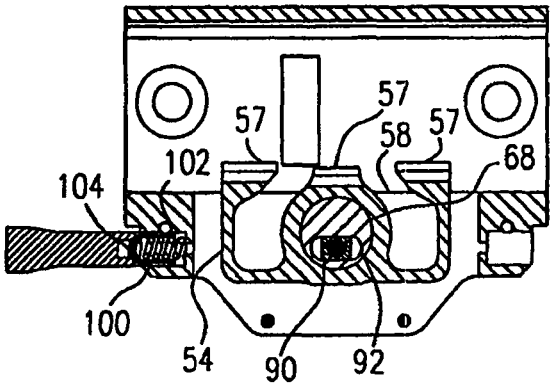
FIG. 13 is similar to FIG. 12, except that the clamp mount is shown in its actuated position.

It may be appreciated that the handle 74 may be rotationally urged or thrown about the axis s of the shaft 70, for rotating or pivoting the shaft 70 about such axis, from an unactuated position (in a clockwise direction as viewed in FIG. 12) to an actuated position shown in FIG. 13, and from the actuated position (in a counterclockwise direction as viewed in FIG. 13) to the unactuated position shown in FIG. 12. When being urged to either of these positions, the handle 74 is preferably stopped from being overthrown by contacting a corresponding one of the stops 98 on the mount base 40. The handle 74 may be restrained against accidental release from its actuated position, such as by means of a spring-biased latch 100 retained by the mount base 40 (e.g., secured in and protruding from a blind longitudinal bore 102 in the mount base 40) for latching engagement with a detent 104 in the handle 74. If desired, the handle 74 may be restrained against accidental release from its unactuated position, such as by a second similar spring-biased latch (not shown) retained by the mount base 40 (e.g., secured within and protruding from a second blind longitudinal bore 102' at the other end of the mount base 40), for latching engagement with the detent 104 in the handle 74.

As represented in FIGS. 2, 5-7, 9 and 11, the clamping member 52 includes at least one second rail-engaging surface 57 opposing the first rail-engaging surface 46 of the mount base second wall 48. In the preferred clamp member embodiment 52, the ends of the two legs 54 of the U-shaped clamping member 52 are each adapted for engaging the wedge-shaped surfaces 38' of the rail 28. Similarly to the first rail-engaging surface 46, each of the second rail-engaging surfaces 57 are configured to matingly engage the rail wedge-shaped surfaces 38', for example each of the second rail-engaging surfaces 57 is preferably V-shaped (in cross-section) for mating with the rail's wedge-shaped surfaces 38'. Preferably, in addition, the longitudinal end of the clamping member center section 58 is similarly configured with a second rail-engaging surface 57 (preferably V-shaped) matingly engagable with the rail wedge-shaped surfaces 38'. As represented in FIG. 12, when the handle 74 is in its unactuated position, the longitudinally disposed second rail-engaging surfaces 57 respectively at the ends of the legs 54 are aligned with each other, while the longitudinally disposed second rail-engaging surfaces 57 at the end of the center section 58 is slightly transversely spaced (toward the base section 56) from the two outer second rail-engaging surfaces 57 of the legs 54; this condition is represented by the dashed line in FIG. 5.

In use, an accessory such as a light beam generator 30 (FIG. 1) is secured to the rail clamp mount 26, for example by securing an accessory holder 32 to the mount base 40 by threadedly securing the holder 32 thereto by means of headed screws seated in recessed bores 43 in the mount base platform 42. The light beam generator 30 may then, or may have been previously, securely mounted in the holder 32. The combination may then be quickly and easily secured to one of the rails 28 of the rail structure 24 (the rail structure bottom rail being shown as the securement rail in FIG. 1), as described below.

The assembled rail clamp mount 26 is applied to the rail 28 with the actuator handle 74 in its unactuated position as shown in FIG. 12. The mount base 40 is placed to the rail 28 with the mount base platform 42 facing the ribs 34 and with the protuberance or transverse bar 50 inserted in one of the transverse slots 36 between two of the ribs 34. In the preferred embodiment, the height of the transverse bar 50 is less than the depth of the transverse slot 36 so that the platform 42 may contact the flat transverse surfaces of the ribs 34. The transverse distance between the first and second walls 44, 48 on either side of the platform 42 is preferably sufficiently greater than the overall transverse width of the rail ribs 34 so as to provide a clearance therebetween with the walls 44 and 48 straddling the rail 28. Such placement of the mount base 40 to the rail 28 is thereby facilitated and it is not necessary to inclinably manipulate the mount base 40 in applying the mount base 40 to the rail 28, for example it is not necessary to tilt the mount base 40 in order to cause the first rail-engaging surface 46 in the first wall 44 to receive the wedge-shaped surfaces 38 along one side of the rail 28.

Figure 14:
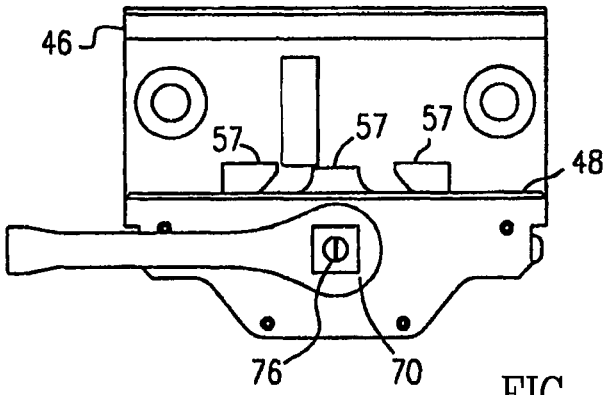
FIG. 14 is a rear/top perspective view of the assembled preferred embodiment of the clamp mount according to the present invention, showing the clamp mount in its actuated position.

After the rail clamp mount 26 is applied to the rail 28 as described, the handle 74 is thrown, i.e. the handle 74 is pivoted about the shaft axis s from its unactuated position shown in FIG. 12 to its actuated position shown in FIGS. 13 and 14. Such rotation of the handle 74 (in the preferred embodiment by approximately 180.degree.) causes rotation of the clamping member disk 68 eccentrically about the axis s of the shaft 70 as previously described.

Figure 5:
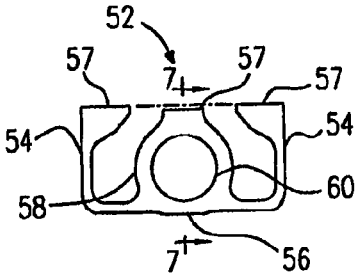
FIG. 5 is a plan view of a preferred embodiment of the clamping member component shown in FIG. 2.
Figure 6:
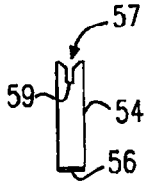
FIG. 6 is an end view of the clamping member shown in FIG. 5.
Figure 7:
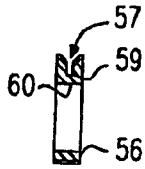
FIG. 7 is a cross-sectional view of the clamping member of FIG. 5, taken along the line 7-7 and viewed in the direction of the appended arrows.
Figure 8:
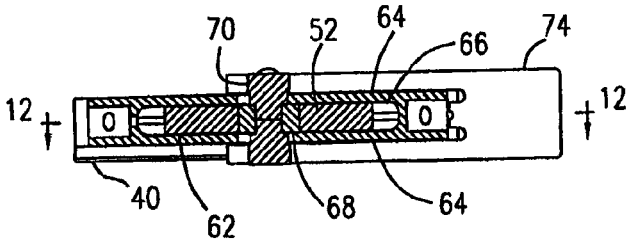
FIG. 8 is a cross-sectional view of the mount base shown in FIGS. 2-4, taken along the line 8-8 of FIG. 4 and viewed in the direction of the appended arrows, FIG. 8 also showing the clamping member and actuator handle components installed to the mount base.

The disk 68 rotates within the clamping member bore 60 as the disk 68 eccentrically rotates about the shaft 70, causing the clamping member 52 to move in the passageway 62 between the flanges 64 and parallel to the plane of the platform 42. The rotational position of the disk 68 with respect to the shaft 70 is such that the clamping member 52 (along with its second rail-engaging surfaces 57) is in its farthest spaced transverse position from the first rail-engaging surfaces 46 when the handle 74 is in its unactuated position. The clamping member's two rail-engaging surfaces 57 at the ends of the legs 54, which transversely protrude slightly with respect to the rail-engaging surface 57 at the clamping surface member's center section 58 as shown in FIG. 5 (i.e., the center section 58 is transversely shorter than the legs 54), are not in contact engagement with the rail 28 when the handle 74 is in its unactuated position.

When the handle 74 is rotated to its actuated position as shown in FIGS. 13 and 14, the rotational position of the disk 52 about the axis of the shaft 70 is such that the clamping member 52 is in its closest spaced transverse position to the first rail-engaging surface 46. At this point, the two rail-engaging surfaces 57 at the ends of the legs 54 of the U-shaped member 52 are moved into contact engagement with and urged against the facing wedge-shaped surfaces 38' of the rail 28, also causing the first rail-engaging surface 46 of the first wall 44 to be urged against its facing wedge-shaped surface 38 of the rail 28, as shown in FIG. 11.

Figure 9:
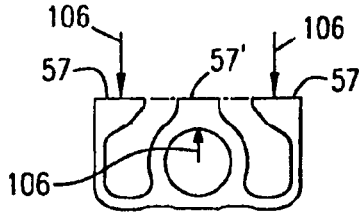
FIG. 9 is a plan view of the clamping member of FIG. 5 demonstrating the elastic configuration thereof when in its clamping condition.

As the eccentrically rotating disk transversely moves the clamping member 52 toward the rail 28 with the two outer rail-engaging surfaces 57 urged against the rail's wedge-shaped surfaces 38', continued transverse movement of the clamping member center section 58 (until the handle 74 is in its fully actuated position as shown in FIGS. 13 and 14), due to the elastic nature of the clamping member 52, permits the center section rail-engaging surface 57 to also engage and be urged against the rail's wedge-shaped surfaces 38'. This configuration of the clamping member 52, where its center section rail-engaging surface 57 is aligned with the two outer rail-engaging surfaces 57, is illustrated in FIG. 9, where the applied and reaction forces are represented by the force arrows 106 and the alignment of the rail-engaged three clamping member surfaces 57 is indicated by the dashed line. The configuration and elastic nature of the clamping member 52 permit the rail clamp mount 26 to be somewhat self-adjusting to the rail 28, which is of particular advantage when the rail clamp mount 26 is employed with non-standard rails, such as with Picatinny rails having oversized or undersized ribs.

In the preferred embodiment, the elastic nature of the clamping member 52 is provided by its generally U-shaped configuration being fabricated of a high strength elastic material such as titanium. The V-shaped first and second rail-engaging surfaces 46 and 57 preferably each include a longitudinal channel or groove 59 (see FIGS. 2, 4, 6, 7 and 11) along the nadir of the V, allowing the V-shaped surfaces to more closely elastically conform to the rail's wedge-shaped surfaces and affording stress relief to the V-shaped surfaces.

The rail clamp mount 26 may be quickly and easily released from the rail 28 by throwing or rotating the throw handle 74 from its actuated position to its unactuated position, thereby reversing rotation of the shaft 70 and the eccentric disk 68, whereby the clamping member is caused to transversely move back into the passageway 62 of the mount base 40.

Figure 2:
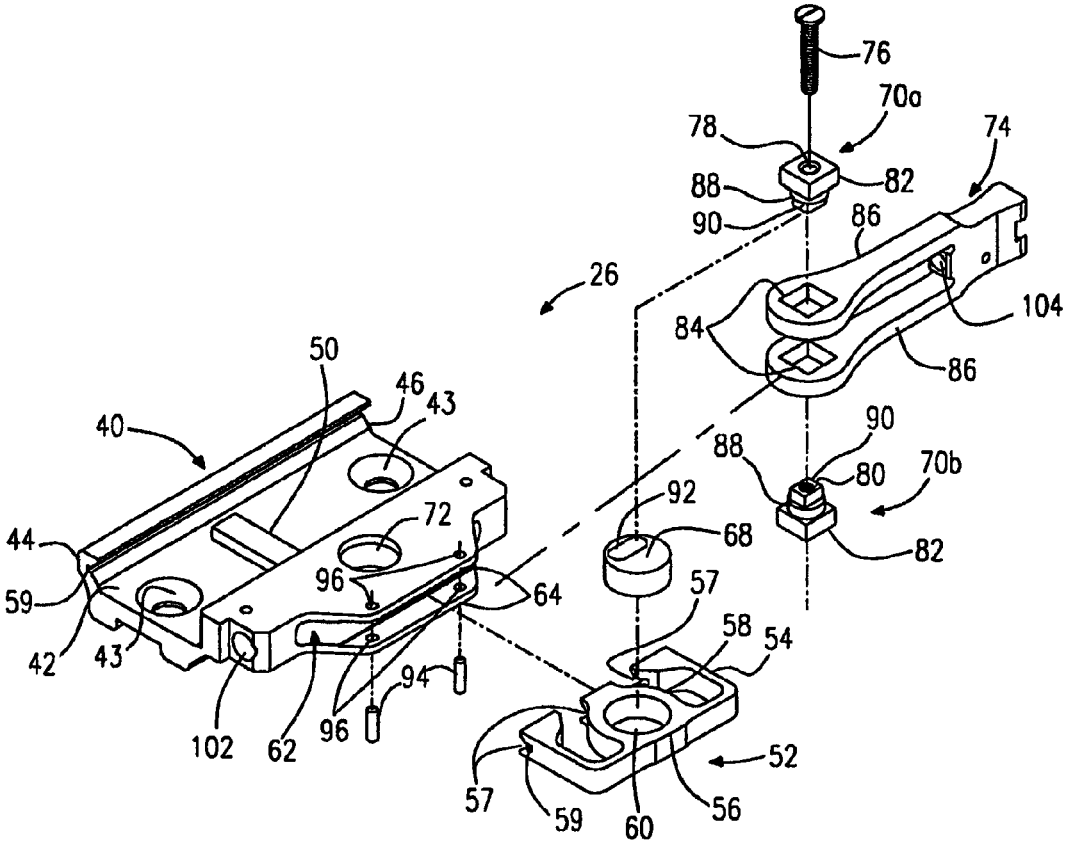
FIG. 2 is an exploded rear/right-side perspective view of the preferred embodiment of the rail clamp mount according to the present invention, shown in increased scale with respect to its representation in FIG. 1.
Figure 3:
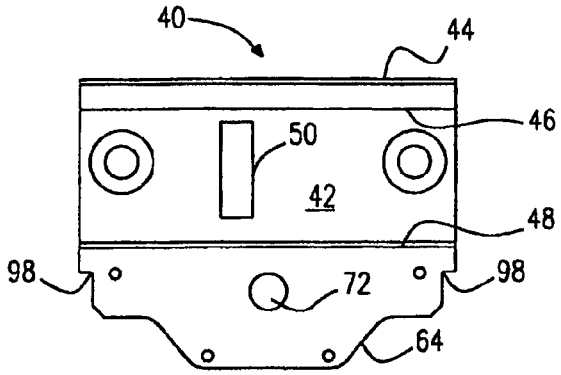
FIG. 3 is a top plan view of a preferred embodiment of the mount base component shown in FIG. 2.
Figure 4:
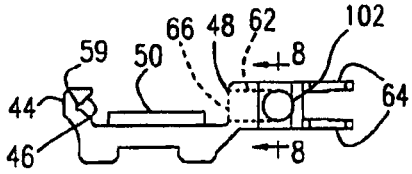
FIG. 4 is a rear end view of the mount base shown in FIG. 3.

The symmetrical features of the various operational components of the rail clamp mount 26 permit the components to be assembled for ambidextrous operation. For example, FIGS. 2, 12 and 13 show the handle 74 and shaft 70 connected to the disk 68 and clamping member 52 in the base 40 such that the handle 74 is forwardly thrown (i.e., to the right as shown in FIGS. 2 and 12) to its unactuated position and is rearwardly thrown to its actuated position shown in FIG. 13. Alternatively, the handle 74 and shaft 70 may be assembled to the disk 68 and clamping member 52 in the base 40 such that the handle 74 is rearwardly oriented in its unactuated position (i.e., 180.degree. from its position shown in FIGS. 2 and 12). In such case, the handle 74 may be forwardly thrown to its actuated position and rearwardly thrown to its unactuated position.

Thus, there has been described a preferred embodiment of a rail clamp mount that may be quickly and easily firmly secured to a longitudinal rail, such as a rail carried by a gun, and that may be quickly and easily released from the rail. Other embodiments of the present invention, and variations of the embodiment presented herein, may be developed without departing from the essential characteristics thereof. Accordingly, the invention should be limited only by the scope of the claims listed below.

What is claimed is:

1. An apparatus for mounting a device to a rail associated with a weapon, the apparatus comprising:

a mount base configured to secure the device thereto and comprising a rail-engaging surface configured to engage a first side of the rail;

an actuator; and a clamping member comprising:

a base section, and two longitudinally spaced-apart legs extending from the base section toward a second side of the rail, wherein the legs provide rail-engaging surfaces substantially at ends of the legs disposed away from the base section, wherein the rail-engaging surfaces of the legs are substantially opposed to and transversely spaced from the second side of the rail and configured to engage the second side of the rail, wherein the legs are configured to move simultaneously toward the second side of the rail in response to the actuator.

2. The apparatus of claim 1, wherein the second side of the rail is substantially opposite the first side of the rail.

3. The apparatus of claim 1, further comprising:

a cam mechanism configured to impart substantially transverse movement to the clamping member in response to the actuator to cause the rail-engaging surfaces of the clamping member to engage the second side of the rail.

4. The apparatus of claim 1, wherein the clamping member is elastic.

5. The apparatus of claim 1, wherein the clamping member is carried by the mount base.

6. The apparatus of claim 1, wherein the clamping member is generally U-shaped.

7. The apparatus of claim 1, wherein the legs are substantially parallel to each other.

8. The apparatus of claim 1, wherein the rail is carried by the weapon.

9. The apparatus of claim 1, wherein the weapon is a firearm.

10. The apparatus of claim 1, wherein the first and second rail-engaging surfaces of the clamping member are configured to engage and disengage the first and second sides of the rail in response to the actuator.

11. The apparatus of claim 1, further comprising a latch comprising a multi-faceted surface configured to engage with a detent of the actuator, wherein the latch is configured to restrain the actuator against release from an actuated position.

12. An apparatus for mounting a device to a rail associated with a weapon, the apparatus comprising:

a mount base configured to secure the device thereto and comprising a rail-engaging surface configured to engage a first side of the rail;

a clamping member comprising:

a base section, and two longitudinally spaced-apart legs extending from the base section toward a second side of the rail, wherein the legs provide rail-engaging surfaces substantially at ends of the legs disposed away from the base section, wherein the rail-engaging surfaces of the legs are substantially opposed to and transversely spaced from the second side of the rail and configured to engage the second side of the rail;

an actuator; and a cam mechanism configured to impart substantially transverse movement to the clam in member in res onse to the actuator to cause the rail-en a in surfaces of the clamping member to engage the second side of the rail, wherein the cam mechanism comprises a rotatable member configured to be rotated eccentrically with respect to the mount base.

13. The apparatus of claim 12, wherein the cam mechanism further comprises a shaft rotatably secured to the mount base and engaged with the rotatable member to rotate the rotatable member in response to the actuator.

14. The apparatus of claim 13, wherein the actuator comprises a handle having an end secured to the shaft and configured to rotate the shaft with respect to the mount base.

15. The apparatus of claim 14, wherein the handle is configured to move between a first position wherein the rail-engaging surfaces of the clamping member are disengaged from the second side of the rail, and a second position wherein the rail-engaging surfaces of the clamping member are engaged with the second side of the rail.

16. The apparatus of claim 12, wherein the legs are substantially parallel to each other.

17. The apparatus of claim 12, further comprising a latch comprising a multi-faceted surface configured to engage with a detent of the actuator, wherein the latch is configured to restrain the actuator against release from an actuated position.

18. An apparatus for mounting a device to a rail associated with a weapon, the apparatus comprising:

a mount base configured to secure the device thereto and comprising a rail-engaging surface configured to engage a first side of the rail; and a clamping member comprising:

a base section, two longitudinally spaced-apart legs extending from the base section toward a second side of the rail, wherein the legs provide rail-engaging surfaces substantially at ends of the legs disposed away from the base section, wherein the rail-engaging surfaces of the legs are substantially opposed to and transversely spaced from the second side of the rail and configured to engage the second side of the rail, and a center section extending from the base section, wherein the center section comprises a rail-engaging surface substantially opposed to and transversely spaced from the second side of the rail.

19. The apparatus of claim 18, wherein the rail-engaging surfaces of the legs are configured to engage the second side of the rail before the rail-engaging surface of the center section engages the second side of the rail as the cam mechanism rotates.

20. The apparatus of claim 18, wherein the center section of the clamping member is transversely shorter than the legs.

21. The apparatus of claim 18, wherein the center section is disposed between the legs.

22. The apparatus of claim 18, wherein the cam mechanism is engaged with a bore in the center section of the clamping member.

23. The apparatus of claim 18, wherein the first and second sides of the rail comprise substantially wedge-shaped surfaces.

24. The apparatus of claim 23, wherein the rail-engaging surfaces of the mount base, the legs, and the center section are generally V-shaped.

25. The apparatus of claim 24, wherein the V of each of the rail-engaging surfaces comprises a groove along the nadir thereof.

26. The apparatus of claim 18, wherein the legs are substantially parallel to each other.

27. The apparatus of claim 18, further comprising a latch comprising a multi-faceted surface configured to engage with a detent of the actuator, wherein the latch is configured to restrain the actuator against release from an actuated position.

28. An apparatus for mounting a device to a rail associated with a weapon, the apparatus comprising:

a mount base configured to secure the device thereto and comprising a rail-engaging surface configured to engage a first side of the rail; and a clamping member comprising:

a base section, two longitudinally spaced-apart legs extending from the base section toward a second side of the rail, wherein the legs provide rail-engaging surfaces substantially at ends of the legs disposed away from the base section, wherein the rail-engaging surfaces of the legs are substantially opposed to and transversely spaced from the second side of the rail and configured to engage the second side of the rail, and a center section extending from the base section, wherein the center section comprises a rail-engaging surface substantially opposed to and transversely spaced from the second side of the rail.

29. The apparatus of claim 28, wherein the legs are substantially parallel to each other.

30. The apparatus of claim 28, further comprising a latch comprising a multi-faceted surface configured to engage with a detent of the actuator, wherein the latch is configured to restrain the actuator against release from an actuated position.

* * * * *